US012624508B2

(12) United States Patent
Bonney

(10) Patent No.: US 12,624,508 B2
(45) Date of Patent: May 12, 2026

(54) ELECTRIC SNOWBLOWER

(71) Applicant: Michael Allen Bonney, Port Charlotte, FL (US)

(72) Inventor: Michael Allen Bonney, Port Charlotte, FL (US)

( * ) Notice: Subject to any disclaimer, the term of this patent is extended or adjusted under 35 U.S.C. 154(b) by 1114 days.

(21) Appl. No.: 17/490,948

(22) Filed: Sep. 30, 2021

(65) Prior Publication Data

US 2022/0098811 A1 Mar. 31, 2022

Related U.S. Application Data

(60) Provisional application No. 63/085,869, filed on Sep. 30, 2020.

(51) Int. Cl.
*E01H 5/09* (2006.01)
*E01H 5/04* (2006.01)

(52) U.S. Cl.
CPC ..... *E01H 5/098* (2013.01); *E01H 5/045* (2013.01)

(58) Field of Classification Search
CPC ..... E01H 5/045; E01H 5/098
See application file for complete search history.

(56) References Cited

U.S. PATENT DOCUMENTS 4,391,052 A * 7/1983 Guy, Jr. ..... E01H 5/098 37/251
5,018,592 A * 5/1991 Buchdrucker ..... B62D 51/004 475/26
5,479,730 A * 1/1996 Gogan ..... E01H 5/098 37/231
6,089,341 A * 7/2000 Gingerich ..... B60L 50/52 180/2.2
6,798,160 B2 * 9/2004 Wakitani ..... B60L 3/0046 318/135
7,195,094 B2 * 3/2007 Street ..... E01H 5/04 180/300
9,903,079 B2 * 2/2018 Palicki ..... E01H 5/045
2006/0236565 A1 10/2006 Gautreau
2007/0062076 A1 * 3/2007 Majkrzak ..... E01H 5/098 37/249
2010/0307270 A1 12/2010 Brick
2013/0291412 A1 * 11/2013 Cmich ..... E01H 5/098 37/251
2019/0003137 A1 * 1/2019 Gao ..... G01S 15/931

OTHER PUBLICATIONS

Canada Office Action from counterpart Patent Application No. 3,193,326 mailed Sep. 8, 2025 (4 pages).

* cited by examiner

*Primary Examiner* — Amber R Anderson
(74) *Attorney, Agent, or Firm* — William H. Honaker; Dickinson Wright PLLC

(57) ABSTRACT

Disclosed is a two-stage electric powered snowblower. It has an auger, a blower, and a main drive shaft. A first electric motor is operably coupled to the drive shaft to rotate the drive shaft at a desired speed. The drive shaft is operably coupled to the auger to rotate the auger. The auger rotates to pull snow into the snowblower housing so that it can be forced out of a chute in the desired direction. A second electric motor is operably coupled to the blower to drive the blower at a desired speed which is typically higher than the speed of the auger. The second electric motor is mounted adjacent the first electric motor. The blower is operably coupled to the second electric motor. The drive shaft extends through the second electric motor the blower.

20 Claims, 5 Drawing Sheets

ELECTRIC SNOWBLOWER

RELATED APPLICATIONS

This application claims the benefit of U.S. Provisional Application No. 63/085,869 filed on Sep. 30, 2020.

STATEMENT REGARDING FEDERALLY SPONSORED RESEARCH

NONE.

TECHNICAL FIELD

This invention relates generally to snowblowers and more particularly to two stage snowblowers.

BACKGROUND OF THE INVENTION

Gas powered snow blowers are very common. They typically are either single stage or dual stage. Single stage gas snow blowers have an auger directly coupled to the gas motor. The auger rotates to force snow up through a discharge chute. Dual stage gas snow blowers have a blower adjacent to the discharge chute and an auger. The auger pulls snow into the snow blower and adjacent the chute. The blower then forces the snow out of the chute. With both the single and dual stage snow blowers, you manually adjust the chute to determine the direction and extent of snow thrown from the chute. Typically, this the user rotates the shoot in the direction where snow is being thrown and adjusts the top of the chute to make the exit opening larger or narrower to control the snow being thrown. As can be appreciated, this can lead to problems of clogging depending upon the size of the opening and the snow and ice conditions.

In the dual stage unit, the gas engine drives both the blower and the auger. This creates the need for complicated gearboxes to provide a high-speed drive to the blower and a lower speed drive to the auger. Additionally, if the auger is slowed down, stopped, or clogged due to heavy snow or ice, the blower is also slowed down or stopped since they are commonly driven by the same drive shaft. This makes the clearing of the snowblower more difficult.

With the recent trend towards replacing gas-powered motors with electric motors, there is a need for an electric powered snowblower. Canadian patent application 3110144 A1 is an attempt to provide an electric powered snowblower. Basically, the snowblower disclosed in the '144 application replaces a gas motor with an electric motor. But the '144 suffers from the same problems as gas powered snow blowers, a single engine driving the auger and the blower.

What is needed is an electric powered snowblower that avoids the problems of driving an auger and a blower with a single motor, is compact and provides high value at a competitive cost.

SUMMARY OF THE INVENTION

In general terms, this invention provides a two-stage electric powered snowblower. It has an auger, a blower, and a main drive shaft. A first electric motor is operably coupled to the drive shaft to rotate the drive shaft at a desired speed. The drive shaft is operably coupled to the auger to rotate the auger. The auger rotates to pull snow into the snowblower housing so that it can be forced out of a chute in the desired direction.

A second electric motor is operably coupled to the blower to drive the blower at a desired speed which is typically higher than the speed of the auger. The second electric motor is mounted in line with the first electric motor. The blower is operably coupled to the second electric motor. The first motor shaft or drive shaft extends through the second electric motor and the blower.

The snow blower includes a pair of drive wheels and an electric motor drive to drive them. The electric motor drive includes at least a third electric motor and gearbox, with the third electric motor and gearbox operatively connected to at least one wheel to drive the snowblower. In the disclosed embodiment, there is a fourth electric motor and gearbox, the third electric motor and gearbox drives one wheel of said snowblower and the fourth electric motor and gearbox drives the other wheel of the snowblower.

To utilize two electric motors, one for the auger and the other for the blower, the blower motor and auger motors are positioned closely together. In one embodiment they are attached. In this embodiment, the blower motor has a hollow shaft to which the blower is mounted. The blower motor also has a bore extending through it. The bore is colinear with the hollow shaft, so that the drive shaft can extend through them and is free to rotate within the bore and the hollow shaft.

In a further embodiment, the blower motor has a hub that is connected to the drive shaft and is journaled within the hub so that the blower is free to rotate with respect to the drive shaft.

These and other features and advantages of this invention will become more apparent to those skilled in the art from the detailed description of a preferred embodiment. The drawings that accompany the detailed description are described below.

DETAILED DESCRIPTION OF A PREFERRED EMBODIMENT

Figure 1:
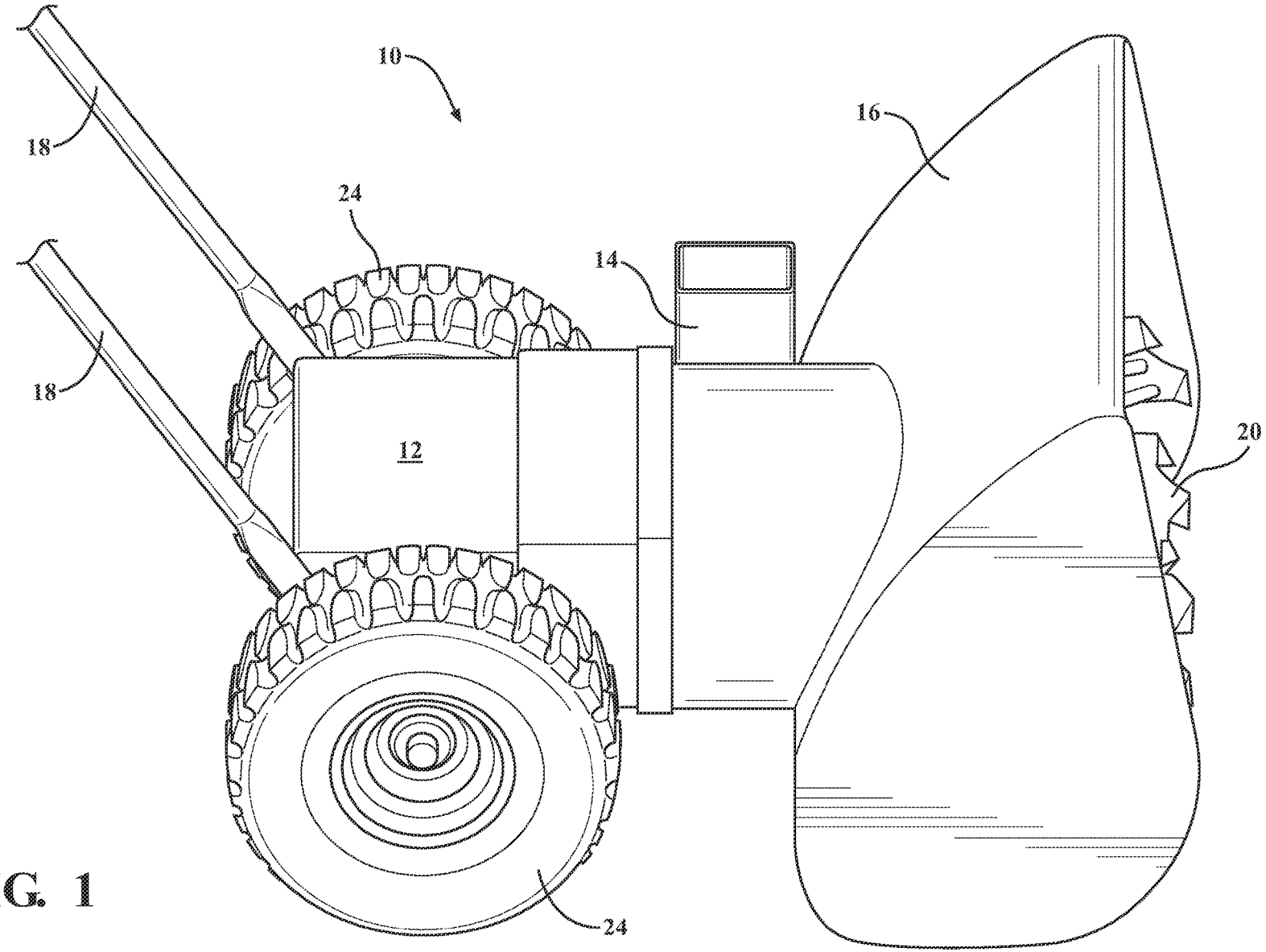
FIG. 1 is a perspective view of the snow blower of the present invention.

The snowblower of the present invention is shown generally at 10 in FIGS. 1 through 3 and 5. The illustrated snowblower 10 has a motor housing 12, a snow chute 14 and an auger housing 16. Control handles 18 are partially shown. The handles 18 extend to a control panel not shown.

The control panel includes the controls for operating the snowblower 10. Controls are provided for controlling the auger 20 and its speed, the blower 22 and its speed and the drive wheels 24 and their speed. The controls can also independently control the direction, either forward or reverse of the auger 20, and drive wheels 24. Controlling the direction of the wheels 24 allows the user to drive the snowblower 10 in forward and reverse. In addition to controlling the wheels 24 in the forward and reverse directions, there is an option to independently control each wheel 24 to aid in steering the snowblower 10. Controlling the direction of the auger 20 allows the operator to easily clean any snow or ice from the snowblower 12.

Figure 2:
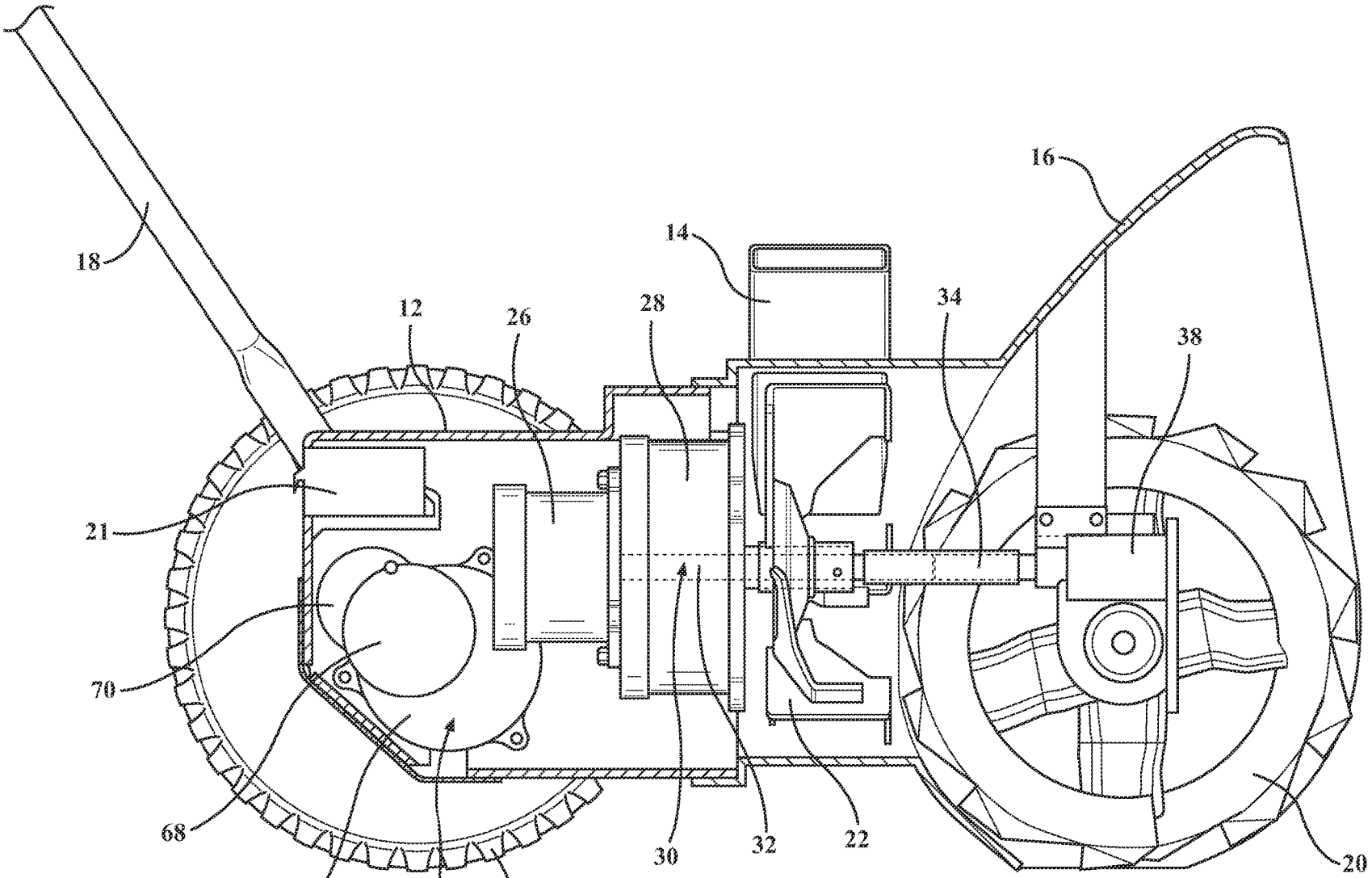
FIG. 2 is a cutaway view of the snow blower of the present invention.
Figure 3:
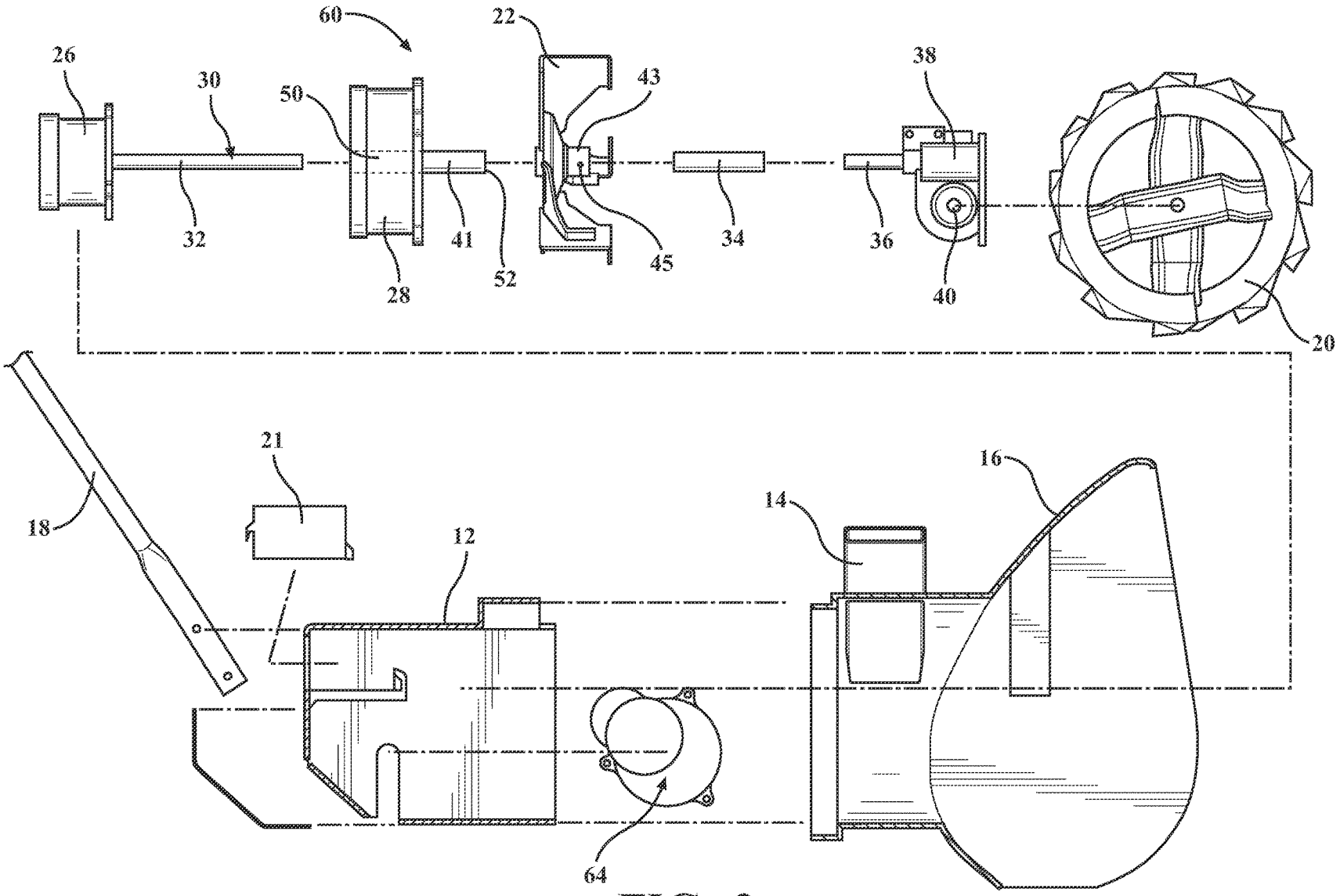
FIG. 3 is an exploded view of the snow blower of the present invention.

With reference to FIGS. 2 and 3, the snowblower 10 includes two electric motors 26 and 28. Auger motor 26 is mounted adjacent the wheels 24, and blower motor 28 is mounted between auger motor 26 and auger 20. The auger motor 26 powers auger 20. The auger motor 26 is a lower speed and low wattage motor. In the disclosed embodiment, it will rotate at about 600 to 900 rpms, and coupled to gearing reducing the auger 20 speed to 75 to 150 RPM and is about 800 or 900 watts peak power. The blower motor 28 powers the blower 22. The blower motor 28 is a higher speed higher wattage motor. In the disclosed embodiment it will generate about 1100 to 1500 rpms and is about 3000 watts peak in this embodiment. Both motors 26 and 28 operate independent of each other. In this way, if the auger 20 is slowed down due to ice build up or heavy snow, the blower motor is not affected. Also, the speed of auger 20 can be adjusted for different snow and ice conditions. The blower 22 speed can also be changed to control the throw of the snow. By increasing the speed of blower 22, snow is thrown further and by decreasing the speed, snow is not thrown as far. All adjustments are controlled from the control panel by the operator. The lower wattage and lower inertia auger motor 26 also eliminates the need for a sheer pen. Because of the lower wattage and intertia, if the auger is blocked and cannot rotate, the electronics can respond with sufficient speed to limit the current through the drive and will not be adversely affected. The motors are powered by a battery 21.

The main driveline 30 extends between the motor 26 to the auger 20. Main driveline 30 includes a main shaft 32 operatively connected to motor 26. A coupling 34 joins the main shaft 32 to the input shaft 36 of a right-angle gearbox 38. The gearbox 38 can be any suitable gearbox, such as for example a worm, bevel, helical, helical bevel, helical worm, planetary and spiral bevel. In the disclosed embodiment the gearbox 38 is a helical gearbox because they are more efficient than other gearbox types and can be back driven by hand to clear the auger as needed. The auger 20 consisting of a right and left half is a coupled to the dual output shaft 40 of the gearbox 38. The auger motor 26 is mounted to the motor housing 12 through a bracket, not shown.

The blower 22 is operatively coupled to blower motor 28. In the disclosed embodiment, the blower 22 has a coupling 43 that receives a lock screw 45. The coupling 43 mounts onto the shaft 41 operatively extending from the blower motor 28.

Figure 4:
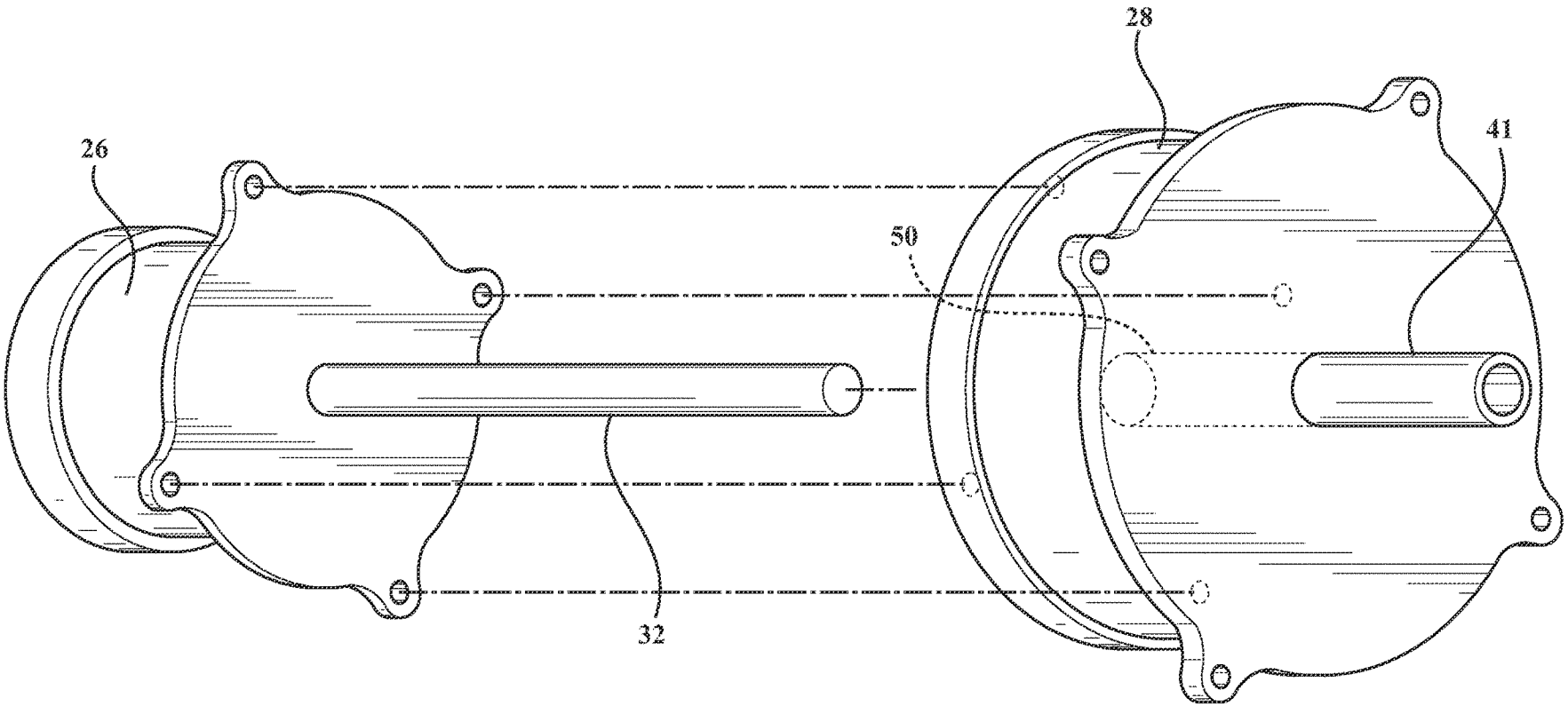
FIG. 4 is a perspective view of the auger motor.

As illustrated, the blower motor 28 is mounted directly to auger motor 26. With reference to FIG. 4, the auger motor has connectors 47 upon which the blower motor 28 is attached. The blower motor 28 has a first bore 50 that extends through the central part of the blower motor 28. The shaft 41 is a hollow tube having a second bore 52 colinear to the first bore 50. The main shaft 32 extends through the first bore 50 and second bore 52. In the disclosed embodiment, the first and second bores are about 20 mm in diameter and the main shaft 32 is about 18.8 mm. In this way, the auger motor 26, blower motor 28, blower 22 and auger 20 assembly, shown generally at 60 is very compact.

Figure 5:
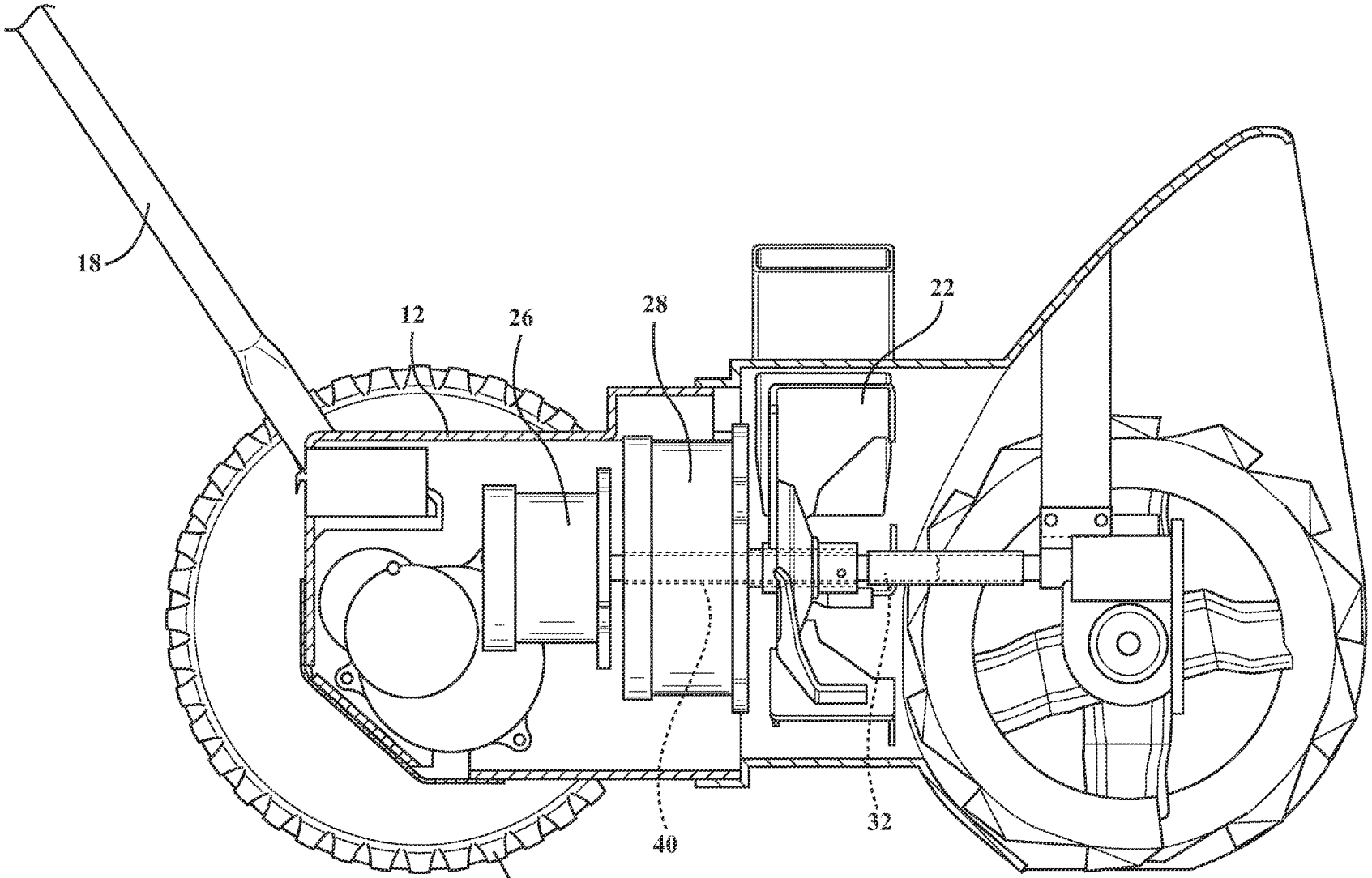
FIG. 5 is a cutaway view of a second embodiment of the present invention.

In a further embodiment as illustrated in FIG. 5, the blower motor 28 is mounted to the motor housing 12. In this embodiment, the auger motor 26 can be mounted to the blower motor 28 as in the previous embodiment or mounted directly to the housing 12. A hub 40 extends through the motor 28 and blower 22. In this embodiment, the main shaft 32 rotates with respect to both the motor 28 and blower 22. The hub 40 can be a brass sleeve, as shown or a bearing assembly, such as a roller or ball bearing.

The drive wheels 24 of the disclosed embodiment are driven by separate two-stage gear boxes shown generally at 64. (Only one is shown in the illustration.) Gear box 64 has a gear reduction 66, a first stage gearing 68 and an electric motor 70. The gear box 64 is mounted to the housing 12. An example of a two-stage gear box 64 is the Bosch Two-stage gear-motor AHC2 0390203226. An example of the first and second motors, for auger and blower are the Kollmorgen KBM(S)-17 3 KW hollow shaft motor with custom frame package for motor 28 the and the Kollmorgen AKMH-41 with extended shaft for the motor 26.

It should be appreciated by those of ordinary skill in the art, that the snow blower 10 would not need powered drive wheels, but could have no power to the wheels 22, the operator supplying the power when he pushes the snow blower 10.

In a further embodiment of the present invention, the speed of the drive wheels 24 can be independently controlled to assist in steering. By increasing the speed of one wheel 22 over the speed of the other wheel 22, the snow blower 10 will turn under power. One wheel could even be reversed with respect to the other wheel to create a zero-turn snow blower 10. In this embodiment, the snow blower 10 will need to have the wheels 22 turning at the same speed when not turning. To do this drive I-R compensation or for higher precision an encoder can be used to synchronize the motors 70. Or, to avoid the use of encoders, a wrap-spring clutch with a solenoid control or similar controller can be used. When the snow blower 10 is going straight and forward, the axles of wheels 22 are operatively connected with the spring clutch engaged. To turn, the solenoid is activated engaging the wrap-spring clutch disconnecting the axels to allow for turns. When operating in reverse the wrap spring is released and the wheels 22 are independently controlled which is consistent with the lower speeds and shorter distance in reverse encountered in snow blower operation.

As a further embodiment, the use of two friction spring clutches with solenoid allows the use of a single electric motor and gearbox assembly 64. The gearbox assembly 64 can be connected to a single axle that drives both wheels. To steer the snowblower 10, a clutch would be disengaged allowing one axle to turn, but not the other. By using two clutches on a double shafted motor or on a separate shaft joined together, the snowblower 10 can be turned either left or right.

In operation, the operator of the snowblower 10 energizes the blower motor 28 and auger motor 26. The speed of both can be adjusted for snow conditions, i.e., heavy, or light snow, ice etc. Additionally, the blower motor can be adjusted to control the distance the snow is thrown from the chute 14. If the snowblower 10 has driven wheels 24, these motors are engaged as well. As will be appreciated the blower motor 28 can be adjusted at the control panel by the operator at any time during operation. In the event the auger 20 is clogged due to snow and ice can conditions, the blower 22 continues to operate avoiding clogging due to the two separate motors.

Additionally, if the auger 20 is clogged, the operator can reverse the auger direction to clear the clog. With the blower 22 still rotating, any snow or ice that is dislodged is remove through the chute 14. In the event reversing the auger motor 26 is an option, manually back driving would not be required. In this situation, the auger is back driven from the control panel.

The foregoing invention has been described in accordance with the relevant legal standards, thus the description is exemplary rather than limiting in nature. Variations and modifications to the disclosed embodiment may become apparent to those skilled in the art and do come within the scope of the invention. Accordingly, the scope of legal protection afforded this invention can only be determined by studying the following claims.

I claim:

1. A snowblower comprising:

an auger, a blower, a drive shaft, a first electric motor operably coupled to said drive shaft to rotate said drive shaft at a desired speed, said drive shaft operably coupled to said auger to rotate said auger;

a second electric motor operably coupled to said blower to drive said blower at a desired speed; and a hub, said hub operatively connected to said second electric motor and said drive shaft being journaled within said hub such that said blower is free to rotate with respect to said drive shaft.

2. The snowblower of claim 1, further including a pair of drive wheels and an electric motor drive to drive said wheels.

3. The snowblower of claim 2, wherein said electric motor drive includes at least a third electric motor and gearbox, said third electric motor and gearbox is operatively connected to at least one wheel to drive said snowblower.

4. The snowblower of claim 3, wherein said electric motor drive includes a fourth electric motor and gearbox, said third electric motor and gearbox is operatively connected to one wheel of said snowblower and said fourth electric motor and gearbox is operatively connected to said other wheel of said snowblower.

5. The snowblower of claim 1, wherein said first electric motor is attached to said second electric motor.

6. The snowblower of claim 1, wherein said second electric motor has a hollow shaft to which said blower is mounted and a bore extending through said second electric motor and colinear with said hollow shaft, said drive shaft extending through said bore and said hollow shaft, wherein said drive shaft is free to rotate within said bore and said hollow shaft.

7. The snowblower of claim 1, wherein said second electric motor has a bore extending through said second electric motor, said drive shaft extending through said bore.

8. The snowblower of claim 1, wherein said first and second electric motors operate independent of one another.

9. The snowblower of claim 1, wherein said first electric motor has a lower wattage and lower revolutions per minute than said second electric motor.

10. The snowblower of claim 1, wherein said first electric motor is operatively connected to a helical right-angle gearbox.

11. A snowblower comprising:

an auger, a blower, a drive shaft, a first electric motor operably coupled to said drive shaft to rotate said drive shaft at a desired speed, said drive shaft operably coupled to said auger to rotate said auger;

a second electric motor operably coupled to said blower to drive said blower at a desired speed;

said drive shaft extending through said second electric motor and said blower.

12. The snowblower of claim 11, further including a pair of drive wheels and an electric motor drive to drive said wheels.

13. The snowblower of claim 11, wherein said electric motor drive includes at a third electric motor and gearbox, and a fourth electric motor and gearbox, said third electric motor and gearbox is operatively connected to one wheel of said snowblower and said fourth electric motor and gearbox is operatively connected to said other wheel of said snowblower.

14. The snowblower of claim 11, wherein said first electric motor is attached to said second electric motor.

15. The snowblower of claim 11, wherein said second electric motor has a hollow shaft to which said blower is mounted and a bore extending through said second electric motor colinear with said hollow shaft, said drive shaft extending through said bore and said hollow shaft, wherein said drive shaft is free to rotate within said bore and said hollow shaft.

16. The snowblower of claim 11, wherein said second electric motor has a bore extending through said second electric motor, said drive shaft extending through said bore.

17. The snowblower of claim 11, further including a hub, said hub operatively connected to said second electric motor and said drive shaft being journaled within said hub such that said blower is free to rotate with respect to said drive shaft.

18. The snowblower of claim 11, wherein said first and second electric motors operate independent of one another.

19. The snowblower of claim 11, wherein said first electric motor has a lower wattage and lower revolutions per minute than said second electric motor.

20. The snowblower of claim 11, wherein said first electric motor is operatively connected to a helical right-angle gearbox.

* * * * *